US006252224B1

(12) United States Patent
Ohkawa

(10) Patent No.: US 6,252,224 B1
(45) Date of Patent: Jun. 26, 2001

(54) CLOSED MAGNETIC FIELD LINE SEPARATOR

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/216,585

(22) Filed: Dec. 18, 1998

(51) Int. Cl.[7] ..... H01J 49/00

(52) U.S. Cl. ..... 250/281; 250/296; 250/298

(58) Field of Search ..... 250/281, 282, 250/294, 296, 297, 298

(56) References Cited

U.S. PATENT DOCUMENTS

| | | | |
|---|---|---|---|
| 4,987,007 | 1/1991 | Wagal et al. . | |
| 5,039,312 | 8/1991 | Hollis, Jr. et al. . | |
| 5,225,740 | 7/1993 | Ohkawa . | |
| 5,350,454 | 9/1994 | Ohkawa . | |
| 5,352,893 | * 10/1994 | Freedman | 250/281 |
| 5,478,608 | 12/1995 | Gorokhovsky . | |
| 5,681,434 | 10/1997 | Eastlund . | |
| 5,868,909 | 2/1999 | Eastlund . | |

OTHER PUBLICATIONS

Ohkawa, T., et al., Plasma Confinement in a toroidal Quadrupole, Physics of Fluids, 12, p. 1926 (1969).
Ohkawa T., et al., Plasma Confinement in D.C. Octopole, Phys Rev. Letters 24, p. 95 (1970).

* cited by examiner

*Primary Examiner*—Kiet T. Nguyen
(74) *Attorney, Agent, or Firm*—Nydegger & Associates

(57) ABSTRACT

A nuclear waste remediation system includes, in-line, an ionizer, an accelerator, an optional cooler and a separator. A pair of co-planar spaced-apart conductors extend the entire length of the system to establish a magnetic field which is perpendicular to the lengthwise dimension of the system. In the ionizer, the conductors are surrounded by casings which hold opposite alternating voltages that ionize a neutral gas. In turn, the ionized gas vaporizes nuclear waste to create a multi-species plasma. In the accelerator, cooler and separator, the conductors are surrounded by casings which carry the same dc current to thereby create an electric field which crosses with the magnetic field. Due to the crossed electric and magnetic fields in the system, and due to control over the ratio of these fields, charged particles in the multi-species plasma are accelerated to a common translational velocity in the accelerator, and are maintained at the common translational velocity in the cooler and a common speed in the separator. Unlike the rest of the system, the separator is curved. Consequently, as charged particles transit the separator, centrifugal forces distribute the particles according to their mass. This process is facilitated by the orientation of the magnetic field in the system.

14 Claims, 2 Drawing Sheets

CLOSED MAGNETIC FIELD LINE SEPARATOR

FIELD OF THE INVENTION

The present invention pertains generally to systems for the remediation and disposal of radioactive nuclear waste. More particularly, the present invention pertains to nuclear waste remediation systems that create centrifugal forces which act on the charged particles of a multi-species plasma to separate, segregate and isolate radionuclides from non-radioactive elements in the plasma. The present invention is particularly, but not necessarily, useful as an apparatus and a system for accelerating all particles in a multi-species plasma to a common translational velocity, injecting the particles into a separator where the particles have a common rotational velocity and the separation is centrifugally accomplished along the magnetic field according to the respective masses of the particles.

BACKGROUND OF THE INVENTION

It is apparent that in recent years there has been an increased public awareness of the problems associated with the disposal of radioactive nuclear waste. Accordingly, significant measures have been taken to isolate and confine nuclear waste so that there is minimal harm to the public and to the environment. Much of this activity has resulted from the fact that the adverse effects of radioactivity are well known and well documented. It is also a fact, however, that many of the measures which have been taken heretofore for the disposal of nuclear waste have been, or are now, ineffective for their intended purpose.

It has been suggested that a solution to the nuclear waste problem is to separate the radionuclides from the non-radioactive particles in the waste. The object here has been to reduce the amount of material that requires special handling, and thereby simplify the disposal process. To dispose of nuclear waste in this manner, however, it is first necessary to vaporize the waste to create a multi-species plasma. Such a plasma will include charged particles of relatively high mass (the radionuclides are in this group), and charged particles of relatively low mass (the non-radioactive elements). As a practical matter, after the nuclear waste has been vaporized, the problem becomes one of effectively separating the higher-mass particles from the lower-mass particles in the plasma.

Plasma centrifuges, which operate in accordance with well known physical principles, have been shown to be capable of creating a distribution in which plasma particles are generally distributed according to their mass. In accordance with centrifuge techniques, charged particles will pass through the centrifuge under the influence of crossed electric and magnetic fields. They are then collected as they exit the centrifuge. As they transit the centrifuge, however, centrifugal forces cause the particles to cross the magnetic field lines which are established in the centrifuge by the magnetic field. Thus, the magnetic field lines resist movement of the charged particles. In turn, the separation of particles in a centrifuge is affected by this resistance. On the other hand, charged particles can move along, rather than across, magnetic field lines, with much less resistance.

It is known that for a charged particle of mass, m, traveling on a curved path having a radius of curvature, r, the centrifugal force $F_c$ acting on the particle can be expressed as:

$$F_c = mr\omega^2$$

where $\omega$ is the angular speed or frequency of rotation of the particle on the path. Further, it is known that a centrifugal force will act on a charged particle to urge the particle toward the outside of the curve on which the particle is traveling. Accordingly, and in light of the above discussion regarding magnetic field lines, if magnetic field lines can be oriented so that a centrifugal force will act generally in the same direction as the magnetic field lines, the particles can move freely along the magnetic field to adjust to the effect of the centrifugal force. Consequently, the centrifugal force can be made more effective for separating particles according to their respective masses.

In light of the above, it is an object of the present invention to provide a nuclear waste remediation system which effectively separates, segregates and isolates particles of a multi-species plasma according to the respective masses of the particles. Another object of the present invention is to provide a nuclear waste remediation system which is capable of accelerating all particles in a multi-species plasma to a common translational velocity in the straight section and a common rotational velocity in the curved separation section so that the various particles in the plasma can be separated from each other according to only the respective masses of the particles. A key element of the present invention is to provide a nuclear waste separation system which eliminates the opposing influence of the magnetic field to the separating influence of the centrifugal force on charged particles. Still another object of the present invention is to provide a nuclear waste remediation system which is simple to use, is relatively easy to manufacture, and is comparatively cost effective.

SUMMARY OF THE PREFERRED EMBODIMENTS

An in-line nuclear waste remediation system includes, in order: 1) an ionizer for transforming nuclear waste into a multi-species plasma; 2) an accelerator for accelerating ions in the multi-species plasma to a common velocity; 3) an optional cooler for uniformly reducing the temperature of all ions in the multi-species plasma; 4) a separator for dispersing ions in the multi-species plasma according to their respective masses; and 5) a plurality of either magnetic or mechanical skimmers for removing ions from the plasma to segregate the ions according to their mass. A common element of all sections of the remediation system are two conductors which traverse the entire length of the system. Importantly, each conductor carries substantially the same current to produce a magnetic field throughout the system which is oriented substantially perpendicular to the direction in which charged particles transit the system. Additionally, casings surround the current carrying conductors. The casings, unlike the conductors which traverse the entire system, are divided so that the casings surrounding the conductors in the ionizer are electrically insulated from the casings which surround the conductors in the remainder of the system.

The purpose of the ionizer section of the present invention is to produce a plasma that vaporizes and ionizes the nuclear waste. A preferred embodiment of the ionizer includes a pair of parallel, co-planar spaced-apart conductors which are each surrounded by a casing. Opposite polarity, time varying voltages are applied to the respective casings and time varying fields induce current flow along the magnetic field lines which link both conductors. As is well known, electrons flowing along common magnetic field lines will ionize a neutral gas. In turn, the resulting plasma will vaporize and ionize the nuclear waste that was earlier placed in the ionizer. As the nuclear waste is vaporized by the plasma, the multi-species plasma is created. The multispecies plasma then drifts from the ionizer into the accelerator.

As implied above, the accelerator includes continuous extension of the conductors from the ionizer. Thus the magnetic field in the accelerator is the same as the magnetic field in the ionizer. The casings which surround the conductors of the accelerator are, however, insulated from the casings which surround the conductors of the ionizer. This is done so that the accelerator can accelerate ions of the multi-species to the same translational velocity. Specifically, in order to accelerate the ions, a dc voltage is applied to the casings of both conductors relative to the vacuum chamber. This induces a drift for all plasma species in a direction that is perpendicular to both the electric and magnetic fields. Importantly, the potential must be constant on each magnetic flux surface which ensures that the ratio of the electric field (E) to the magnetic field (B) will be uniform throughout the accelerator chamber, i.e. E/B=constant in order that all ions are accelerated in the system to a common translational velocity.

Downstream from the accelerator, and upstream from the separator, is the optional cooler. For the present invention, the cooler is basically an expansion chamber which allows the multi-species plasma to expand, and thereby cool, after it has left the accelerator. The optional cooler allows improved separation efficiency since the separation depends exponentially on the inverse of the temperature. Structurally, the cooler is a tapered section of the chamber which transitions from the smaller cross sectional area of the accelerator to a larger cross sectional area in the separator. The two conductors in the accelerator continue through the cooler and are proportionately separated to assume appropriate geometries for maintaining the ions at a common translational velocity as they are being cooled.

It is an important feature of the present invention that as the ions of the multi-species plasma enter the separator, they will all have the same translational velocity. Also, they will all have the same, albeit lower, temperature. These lower temperature ions then enter the separator.

As intended for the present invention, the separator is a portion of the chamber which establishes a curved path for the ions of the multi-species plasma. Importantly, like all other components of the system, the magnetic field that is generated by the conductors in the separator is maintained perpendicular to the intended path of the ions. Specifically, this is accomplished in the separator by continuing the conductors along the curved path inside the chamber.

Due to its curved configuration, as ions pass through the separator the influence of centrifugal forces on the ions in the multi-species plasma will cause them to move parallel to the magnetic field and toward the outer edge of the curve. As the ions move in this manner, they are impeded only by the resulting pressure gradient. Accordingly, the heavier ions will tend to concentrate at the outer edge of the separator. Lighter ions will also be concentrated at the outer edge, but since the centrifugal force is smaller by their respective masses, the concentration is much weaker. In this manner, the ions are separated. Since the potential is constant on a magnetic flux surface, the velocity (E/B) at the outer radii where the magnetic field is weaker, is faster than the inner radius where the magnetic field is stronger and $R\omega^2$ is maintained constant. The plasma transits the curved path as a rigid body with constant rotational speed.

Alternate embodiments of the separator geometry can be envisioned which employ the same basic property of separation based on mass dependence due to a centrifugal force, acting parallel to the magnetic field on particles traveling a curved path perpendicular to the magnetic field. With sufficient rotational velocity the heavy ions will be moved to the outer most radius in the toroidal passage through the system. Further mass selection can be accomplished by additional stages. In any case, the choice of the detailed magnetic geometry is important to ensure plasma stability.

As intended for the present invention, skimmers are placed at predetermined locations along the outer edge of the curved separator to collect ions from the multi-species plasma. Specifically, multiple skimmers can be placed near the outer edge of the separator to collect the heaviest ions. For one embodiment of the present invention, magnetic skimmers can be used and positioned at predetermined points along the outer edge of the curved separator. As intended for the present invention, these magnetic skimmers will have a chamber and a pair of parallel conductors, much like the system itself. As such, each magnetic skimmer will create a magnetic field which interacts with that of the system to collect ions from the multi-species plasma at the particular point on the outer edge of the separator. In another embodiment of the present invention, mechanical skimmers, rather than magnetic skimmers, can be used. For example, deflector plates can be appropriately arranged along the outer edge to remove ions from the multispecies plasma at particular points on the outer edge of the separator. These mechanical skimmers are designed to deflect the captured ion, or resulting neutral, and direct it to the collector. Regardless of the type of skimmer used, the remediation system proposed here has the desirable feature that the heavy mass radionuclides are removed first. The lighter mass, more benign elements are then collected at the end of the system. The separation system of the present invention also works on multiple charged ion species in contrast to other separation schemes.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
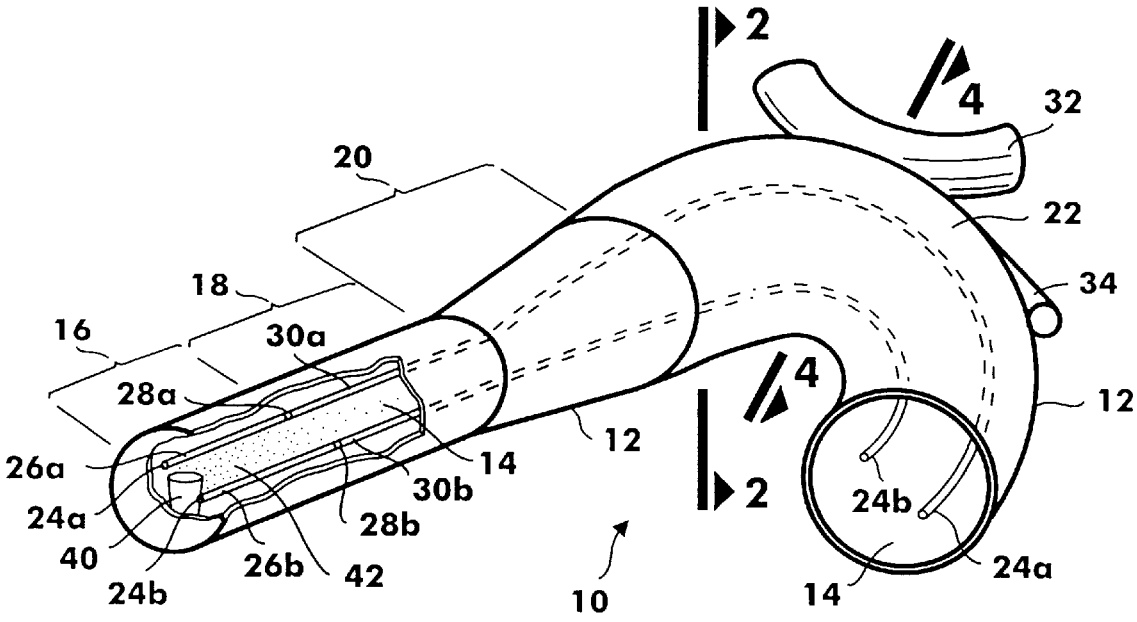
FIG. 1 is a perspective view of the nuclear waste remediation system of the present invention with portions broken away and portions shown in phantom for clarity.

Referring initially to FIG. 1, a nuclear waste remediation system in accordance with the present invention is shown and generally designated 10. For the present invention, the system 10 includes a conduit 12 which is formed with a vacuum chamber 14 which extends along the entire length of the system 10. As shown in FIG. 1, the system 10 can be functionally divided into separate compartments. In order, from an upstream location to a downstream location, these compartments are: an ionizer 16, an accelerator 18, an optional expansion chamber 20 and a separator 22.

An important aspect of the system 10 is a pair of co-planar conductors 24*a* and 24*b* which are mounted in the chamber 14 and which traverse the length of the chamber 14. As intended for the present invention, each of the conductors 24*a,b* carries substantially the same electrical current so that a magnetic field is established in the chamber which is oriented substantially perpendicular to a longitudinal axis (i.e. lengthwise dimension) of the conduit 12. With this orientation, the magnetic field will also be substantially perpendicular to the direction in which charged particles (ions) will transit the system 10 through the chamber 14. The electrical current which is carried on the conductors 24*a,b* for the purpose of establishing the magnetic field can be supplied by any means well known in the pertinent art.

Surrounding the conductors 24*a,b* in the ionizer 16 of system 10 are a pair of respective casings 26*a,b*. As shown in FIG. 1, a pair of insulators 28*a,b* respectively isolate these casings 26*a,b* in the ionizer 16 from a pair of similar casings 30*a,b* which surround the conductors 24*a,b* in the remainder of the system 10. More specifically, a voltage source (not shown) applies an opposite voltage to each of the respective casings 26*a,b* in the ionizer 16. On the other hand, a common dc voltage is applied to the casings 30*a,b* which extend downstream from the accelerator 18, through the expansion chamber 20 and through the separator 22. For the purposes of the present invention, the insulators 28*a,b* can be made of any suitable dielectric material that is well known in the art. Also it is to be appreciated that a suitable dielectric material can be used to electrically isolate the conductors 24a,bfrom respective casings 26*a,b* and 30*a,b*.

It is to be noted that the optional expansion chamber 20 of the system 10 is formed with a taper which has an increasing cross sectional area in the downstream direction. Further, the conductors 24*a,b* and their surrounding casings 30*a,b* which are in the expansion chamber 20 are proportionately spread with the taper to maintain an appropriate operational configuration between the conductors 24*a,b*, the casings 30*a,b* and the conduit 12.

For the present invention, the ionizer 16, accelerator 18 and expansion chamber 20 are all substantially straight. On the other hand, FIG. 1 shows that the separator 22 is curved or toroidal. Additionally, FIG. 1 shows that the system 10 may incorporate either magnetic skimmers, of which the skimmer 32 is exemplary, or mechanical skimmers, of which the skimmer 34 is exemplary. As intended for the present invention, at least one, and possibly a plurality of skimmers 32 or skimmers 34, are incorporated. Regardless which type skimmer 32 or 34 is incorporated, the skimmer 32, 34 will be located on the outside of the curve in the separator 22 substantially as shown in FIG. 1.

Figure 2:
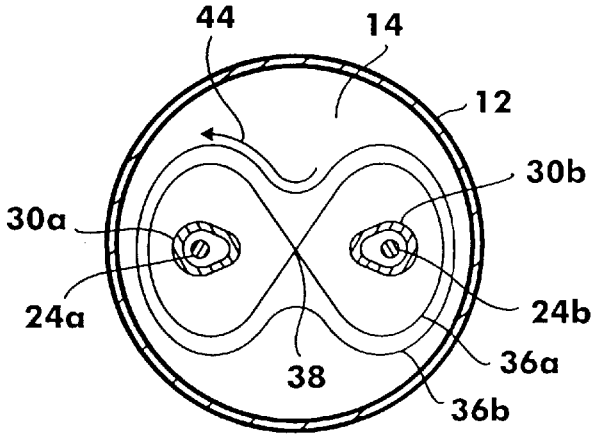
FIG. 2 is a cross sectional view of the nuclear waste remediation system as seen along the line 2—2 in FIG. 1.

In the operation of the nuclear waste remediation system 10 of the present invention, a current is applied to the conductors 24*a,b*. This establishes a magnetic field which extends the length of the chamber 14 and which can be generally represented by magnetic field lines 36. The magnetic field lines 36*a,b* shown in FIG. 2 are only representative. Importantly, as indicated above, the magnetic field lines 36 will all lie in a plane which is substantially perpendicular to the longitudinal axis of the chamber 14 and, thus, of the conduit 12 also. Due to the manner in which the magnetic field is generated by the conductors 24*a,b*, the magnetic field line 36*a* will establish a separatrix 38 that is located directly between the two conductors 24*a,b*. A consequence of this is that the magnetic field line 36*b*, as well as all of the other magnetic field lines 36 which are established outside the magnetic field line 36*a*, will extend around both of the conductors 24*a,b* substantially as shown. Thus, the magnetic field line 36*b* establishes a continuous path from one side of the chamber 14 to the other. As will be appreciated by the skilled artisan, some of these magnetic field lines will create more direct paths from one side of the chamber 14 to the other, than will other magnetic field lines.

As stated above, the casings 26*a,b* in the ionizer 16 are electrically isolated from the casings 30*a,b* which are in the remainder of the chamber 14. Specifically, this isolation allows opposite voltages on the casings 26*a,b* to be alternated. As is well known in the pertinent art, by alternating opposite voltages on the casings 26*a,b*, an induced current is generated which flows along common magnetic field lines 36. In turn, this induced current will then ionize a neutral gas when the neutral gas is introduced into the ionizer 16. Consequently, when a substance, such as nuclear waste 40, is positioned in the ionizer 16 and is contacted by the ionized neutral gas, a multi-species plasma 42 is created from the nuclear waste 40. As indicated above, this multi-species plasma 42 will include both heavy mass charged particles (typically radionuclides) and low mass charged particles which are typically non-radioactive.

In the accelerator 18, as mentioned above, the casings 30*a,b* do not carry opposite voltages. Instead, they are similarly charged relative to the conduit 12 and are shaped to establish an electric field which is substantially crossed with the magnetic field that is created by the conductors 24*a,b*. With these crossed electric and magnetic fields, the charged particles which are in the multi-species plasma 42 are caused to move through the system 10 in a downstream direction, i.e. from the accelerator 18 toward the expansion chamber 20 and the separator 22. Importantly, the crossed electric field (E) and magnetic field (B) are established so that the ratio E/B is substantially uniform. Under such conditions in the accelerator 18, the charged particles in the multi-species plasma 42 are all accelerated to a common translational velocity. Accordingly, charged particles entering the expansion chamber 20 from the accelerator 18 will all have substantially the same translational velocity. The expansion chamber 20 is then provided to allow the charged particles in multi-species plasma 42 to be cooled through the expansion process. Throughout this cooling process, however, the charged particles all maintain substantially common translational velocities.

The separator 22, as shown in FIG. 1, is curved. Consequently, as the charged particles in multi-species plasma 42 transit the separator 22, they are subjected to a centrifugal force, $F_c$, which is mathematically expressed as $F_c = mr\omega^2$. For this expression, m is the mass of a particular charged particle, r is the radius of the path on which the charged particle is traveling in the separator 22, and $\omega$ is the angular velocity of frequency of the charged particle. Through physics well known to the skilled artisan, the centrifugal force $F_C$ which is generated in the separator 22 will force each charged particle toward the outside of the curve. Importantly, as best appreciated with reference to FIG. 2, due to the orientation of the magnetic field lines 36, the centrifugal force $F_c$ will move charged particles along these magnetic field lines 36 in a direction indicated by the arrow 44, rather than across the lines 36 (i.e. perpendicular to the lines 36). The significance of this is that the charged particles do not encounter an opposition from the magnetic field that would otherwise result if the particles were forced to cross the magnetic field lines 36. Importantly, this situation allows the centrifugal force $F_c$ to be more effective in separating the charged particles according to their respective masses. Further, it will be appreciated by the skilled artisan that the common angular speed for all charged particles as they transit the separator 22 is maintained by keeping the potential constant on a magnetic flux line which results in a variation of the ratio E/B in the separator. It is the ratio E/B which accounts for changes in the radius, r , of the paths traveled by the charged particles to maintain a constant angular speed.

Figure 3:
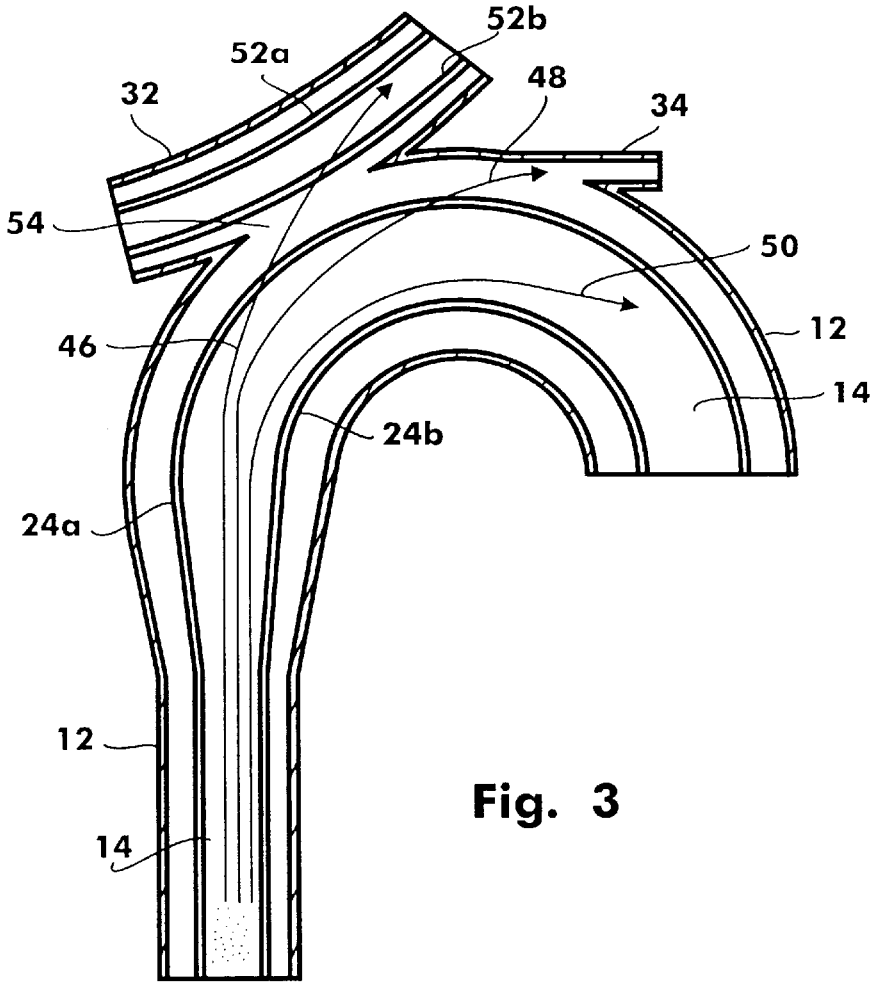
FIG. 3 is a top plan schematic view of the nuclear waste remediation system.

With reference to FIG. 3, it can be seen how the paths of charged particle fluid in the multi-species plasma 42 will be changed according to the respective fluid masses as they transit the separator 22. Specifically, the paths 46, 48 and 50 are depicted in FIG. 3 to represent the different trajectories of three representative charged particle fluids. Each fluid is subjected to centrifugal forces in the separator 22 and they are, respectively, of heavy mass (path 46), intermediate mass (path 48), and light mass (path 50). As depicted, the different masses of the charged particle fluid cause them to travel the different paths 46, 48, or 50, and this difference makes particles of substantially the same mass susceptible to being collected by the same, previously positioned, skimmers 32. For the situation shown in FIG. 3, the particles collected by skimmer 32 and 34 have proportionally more of the heaviest mass particles. With this in mind, it is to be appreciated that the skimmers 32, 34 are only exemplary and that a plurality of different skimmers can be pre-positioned as desired.

Figure 4:
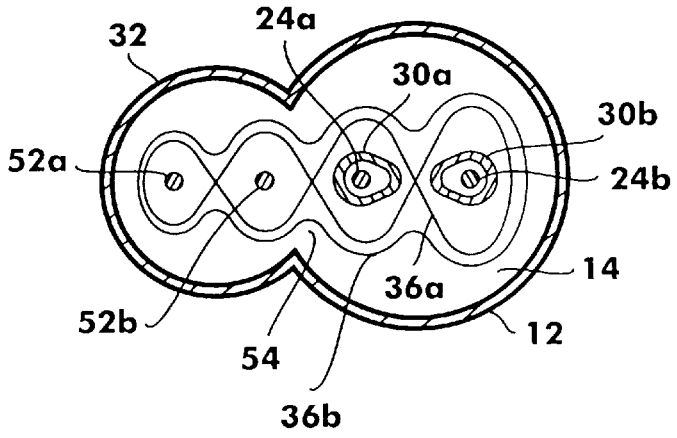
FIG. 4 is a cross sectional view of the nuclear waste remediation system as seen along the line 4—4 in FIG. 1.

Still referring to FIG. 3 it will be seen that, in addition to being positioned at different locations on the separator 22, the skimmers can be of various types. For example, the skimmer 32 is of a magnetic configuration, while the skimmer 34 is of a mechanical configuration. More specifically, the skimmer 32 is provided with a pair of substantially co-planar spaced-apart conductors 52*a* and 52*b* which each carry a current to establish a magnetic field in the skimmer 32. The magnetic field in the skimmer 32, like the magnetic field in the chamber 14, is oriented perpendicular to the lengthwise dimension of the skimmer 32. Accordingly, by cross referencing FIGS. 3 and 4, it will be seen that the magnetic field in the skimmer 32 interacts with the magnetic field in the chamber 14 in the interface region 54 to establish extended magnetic field lines. The magnetic field lines 36*a* and 36*b* shown in FIG. 4 are only representative. For the same reasons discussed above, magnetic field lines, such as the line 36*b* which extends from the chamber 14 into the skimmer 32 will facilitate the action of centrifugal forces, $F_c$, on the particles. Stated differently, the non-opposition of the magnetic field lines facilitates the collection of charged particles in the skimmer 32. In FIG. 3, the skimmer 32 is shown generally positioned for the collection of the heavier mass charged particle fluid. This heavier mass charged particle fluid element will transit the separator 22 along an exemplary path 46. FIG. 3 also shows a mechanical skimmer 34 which is generally positioned to collect the charged particle fluid of intermediate mass which will transit the separator 22 along an exemplary path 48. As shown, the mechanical skimmer 34 is essentially a trap or a gate whereby the intermediate mass charged particle fluid, or a gate whereby the intermediate mass charged particle fluid can be preferentially collected and removed from the chamber after the heavier mass charged particle fluid has been removed at skimmer 34.

While the particular Nuclear Waste Remediation System With Skimmers as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A nuclear waste remediation system which comprises:

an elongated conduit forming a substantially hollow vacuum chamber, said conduit having a substantially straight portion and a curved portion;

a pair of juxtaposed, substantially co-planar conductors mounted in said chamber for generating a magnetic field therein;

a pair of casings, each said casing surrounding a respective one said conductor, with each said casing having an upstream section and a downstream section;

means for alternating opposite voltages on said upstream sections of said casings to ionize the nuclear waste and create a multi-species plasma having a plurality of ions of different masses;

means for establishing a dc voltage on said downstream sections of said casings to accelerate all ions of the multi-species plasma in a downstream direction along a path to a substantially common speed; and at least one skimmer mounted on said curved portion for collecting particles of a predetermined mass from the multi-species plasma as the plasma transits said curved portion of said conduit.

2. A system as recited in claim 1 wherein each said casing further comprises a dielectric material for separating said upstream section from said downstream section.

3. A system as recited in claim 1 wherein said dc voltages on said downstream portions of said casings generate an electric field, and wherein a ratio of respective magnitudes of said electric field and said magnetic field is established to achieve said substantially common translational velocity.

4. A system as recited in claim 1 wherein said magnetic field is substantially perpendicular to said path of the ions in the multi-species plasma through said chamber.

5. A system as recited in claim 1 further comprising an expansion chamber in said straight portion of said conduit for cooling ions of the multi-species plasma while maintaining the common translational velocity for all ions.

6. A system as recited in claim 1 wherein said skimmer is a mechanical gate-like structure.

7. A system as recited in claim 1 wherein said skimmer has a magnetic field with a segment of said magnetic field of said skimmer being substantially coplanar to a segment of said magnetic field in said conduit.

8. An in-line nuclear waste remediation system which comprises:

an ionizer for transforming nuclear waste into a multi-species plasma having a plurality of ions of different masses;

an accelerator positioned downstream from said ionizer for accelerating ions in the multi-species plasma to a substantially common speed;

a separator positioned downstream from said accelerator for maintaining the common speed and dispersing the ions in the multi-species plasma according to their respective masses; and at least one skimmer mounted on said separator for removing ions from the plasma to segregate the ions according to their mass.

9. A system as recited in claim 8 wherein said ionizer comprises:

substantially straight conduit forming a substantially hollow vacuum chamber;

a pair of juxtaposed, substantially co-planar conductors mounted in said chamber;

a pair of casings, each said casing surrounding a respective one said conductor; and means for alternating opposite voltages on said casings to ionize the nuclear waste and create the multi-species plasma.

10. A system as recited in claim 9 wherein said accelerator comprises:

a substantially straight conduit forming a substantially hollow vacuum chamber contiguous with said chamber of said ionizer;

a pair of juxtaposed, substantially co-planar conductors extending from said conductors of said ionizer to generate a magnetic field in said chamber;

a pair of casings, each said casing surrounding a respective one said conductor of said accelerator; and means for establishing a dc voltage on said casings of said accelerator to accelerate all ions of the multi-species plasma in a downstream direction along a path to said substantially common translational velocity.

11. A system as recited in claim 10 wherein said separator comprises:

a curved conduit forming a substantially hollow vacuum chamber contiguous with said chamber of said accelerator;

a pair of juxtaposed, substantially co-planar conductors extending from said conductors of said accelerator to generate a magnetic field in said chamber;

a pair of casings, each said casing surrounding a respective one said conductor of said separator, said casings of said separator being extensions of said conductors of said accelerator; and means for establishing a dc voltage on said casings of said separator to maintain said common speed.

12. A system as recited in claim 11 further comprising an expansion chamber, wherein said expansion chamber interconnects said accelerator with said separator and wherein said expansion chamber comprises:

a substantially straight conduit formed with a taper for cooling ions transitioning said expansion chamber, said taper being oriented to give said conduit of said expansion chamber an increasing cross sectional area in a downstream direction from said accelerator to said separator;

a pair of juxtaposed, substantially co-planar conductors extending between said conductors of said accelerator and said conductors of said separator to generate a magnetic field in said chamber;

a pair of casings, each said casing surrounding a respective one said conductor of said expansion chamber; and means for establishing a dc voltage on said casings of said expansion chamber to maintain said common translational velocity.

13. A system as recited in claim 12 wherein said magnetic field is substantially perpendicular to said path of the ions in the multi-species plasma through said chamber and wherein said skimmer has a magnetic field with a segment of said magnetic field of said skimmer being substantially coplanar to a segment of said magnetic field in said conduit.

14. A system as recited in claim 12 wherein said skimmer is a mechanical gate-like structure.

* * * * *